US011224779B2

(12) United States Patent
Fellows et al.

(10) Patent No.: US 11,224,779 B2
(45) Date of Patent: Jan. 18, 2022

(54) WEIGHTED WALKER ATTACHMENT SYSTEM

(71) Applicant: FALI Rehab Equipment, LLC, Salem, CT (US)

(72) Inventors: Nicole C. Fellows, Groton, CT (US); Sarah A. Ali, Salem, CT (US)

(73) Assignee: FALI REHAB EQUIPMENT, LLC, Salem, CT (US)

( * ) Notice: Subject to any disclaimer, the term of this patent is extended or adjusted under 35 U.S.C. 154(b) by 63 days.

(21) Appl. No.: 16/525,840

(22) Filed: Jul. 30, 2019

(65) Prior Publication Data

US 2020/0078629 A1 Mar. 12, 2020

Related U.S. Application Data

(60) Provisional application No. 62/848,677, filed on May 16, 2019, provisional application No. 62/729,100, filed on Sep. 10, 2018.

(51) Int. Cl.
*A63B 21/06* (2006.01)
*A63B 21/00* (2006.01)
(Continued)

(52) U.S. Cl.
CPC ..... *A63B 21/0604* (2013.01); *A61H 3/04* (2013.01); *A63B 21/00061* (2013.01);
(Continued)

(58) Field of Classification Search
CPC ..... G09B 19/00; A63B 71/0009; A63B 17/04; A63B 21/026; A63B 21/4019;
(Continued)

(56) References Cited

U.S. PATENT DOCUMENTS 4,368,898 A * 1/1983 Lay ..... A63B 71/0009 280/304.1
4,753,449 A * 6/1988 Doucet ..... A63B 71/0009 280/304.1
(Continued)

FOREIGN PATENT DOCUMENTS

JP 2010-57594 A 3/2010

OTHER PUBLICATIONS international Search Report and Written Opinion for PCT international Application No. PCT/US2019/050137, dated Oct. 25, 2019, 8 pages.

*Primary Examiner* — Garrett K Atkinson
(74) *Attorney, Agent, or Firm* — Lathrop GPM LLP; Wm. Tucker Griffith

(57) ABSTRACT

A weighted walker attachment system generally comprises a kit of weighted walker attachments that can be mounted to standard walker or other assistive perambulatory device for use in physical therapy and rehabilitation. A plurality of weighted attachments are provided and adapted to be mounted at a variety of locations on an assistive device. The weight of each attachment can be adjusted, as needed, for example, by adding or removing individual weighted plates mounted on a base plate that itself is removably mounted to the assistive device. In alternate kits, interchangeable weighted attachments can be provided in varying weights, distinguished by optical and/or tactile indicators, and selectively mounted on the assistive device, either as an accessory or in replacing a portion of the device, such as extensions provided on a walker's legs, in accordance with a therapeutic rehabilitation plan for an individual patient.

11 Claims, 9 Drawing Sheets

(51) Int. Cl.
*A63B 23/04* (2006.01)
*A61H 3/04* (2006.01)
*A61H 3/00* (2006.01)

(52) U.S. Cl.
CPC .... *A63B 21/00065* (2013.01); *A63B 23/0464* (2013.01); *A61H 2003/002* (2013.01)

(58) Field of Classification Search
CPC ..... A63B 69/18; A63B 21/06; A63B 21/068; A63B 21/151; A63B 22/20; A63B 23/03516; A63B 23/0355; A63B 23/0405; A63B 23/047; A63B 23/1209; A63B 21/00069; A63B 2071/0625; A63B 21/00061; A63B 21/1609; A63B 21/4034; A63B 21/4043; A63B 2071/025; A63B 59/50; A63B 63/08; A63B 69/0088; A63B 71/023; A63B 71/141; A63B 59/42; A63B 59/00; A63B 59/20; A63B 2209/10; A63B 2210/50; A63B 2225/09; A63B 59/70; A63B 2071/0018; A63B 21/4035; A63B 5/20; A63B 21/0604; A63B 23/0464; A63B 21/00065; A61H 2003/002; A61H 2201/1635; A61H 2201/1685; A61H 2201/0192; A61H 3/04
See application file for complete search history.

(56) References Cited

U.S. PATENT DOCUMENTS 4,824,132 A * 4/1989 Moore ..... A61G 5/023 280/250.1
4,826,151 A * 5/1989 Nuredin ..... A63B 21/0004 297/423.38
5,139,040 A * 8/1992 Kelly ..... A61H 3/02 135/69
5,397,154 A * 3/1995 Baldwin ..... A63C 3/00 188/8
5,443,435 A * 8/1995 Wilkinson ..... A45B 3/00 482/109
5,490,825 A * 2/1996 Wilkinson ..... A45B 3/00 482/109
5,520,597 A * 5/1996 Tobin ..... A61H 3/00 135/67
5,586,957 A * 12/1996 Wilkinson ..... A45B 3/00 482/74
5,653,664 A * 8/1997 Jennings ..... A63B 15/00 473/256
5,807,185 A * 9/1998 Raubuck ..... A63B 65/12 124/1
5,807,211 A * 9/1998 Berryhill ..... A63B 21/0552 482/129
5,876,312 A * 3/1999 McClendon ..... A63B 15/00 482/93
6,004,233 A * 12/1999 Raubuck ..... A63B 65/12 124/20.1
6,042,482 A * 3/2000 Wilds ..... A63D 5/00 273/120 R
6,085,766 A * 7/2000 Geary ..... F16M 11/28 135/75
6,453,921 B1 * 9/2002 Rost ..... A61H 3/00 135/67
6,539,965 B1 * 4/2003 White, III ..... A45B 3/08 135/65
6,612,971 B1 * 9/2003 Morris ..... A63B 23/047 473/441
6,645,127 B1 * 11/2003 Pestes ..... A63B 21/225 482/51
6,692,417 B2 * 2/2004 Burrell ..... A63B 21/00047 482/141
7,001,313 B1 * 2/2006 Crnkovich ..... A61H 3/04 135/67
7,557,286 B2 * 7/2009 Capotosto ..... A63B 15/00 482/109
7,708,671 B2 * 5/2010 Burkhardt ..... A63B 21/026 482/92
7,712,478 B2 * 5/2010 Gibbons ..... A61H 3/02 135/73
7,874,962 B1 * 1/2011 Pestes ..... A63B 22/02 482/65
8,162,809 B1 * 4/2012 Eastwood ..... A63B 21/0552 482/123
8,434,824 B2 * 5/2013 Spinabella ..... A63B 21/4043 297/423.1
8,500,609 B1 * 8/2013 Williams ..... A63B 21/0726 482/108
8,961,186 B2 * 2/2015 LoSasso ..... G09B 19/003 434/255
8,979,196 B2 * 3/2015 Simpson ..... A61G 5/1091 297/230.14
9,149,408 B2 * 10/2015 Karlovich ..... A47C 7/02
9,277,794 B2 * 3/2016 Moreau ..... A45B 9/00
9,393,173 B1 * 7/2016 Meza ..... A61H 3/04
10,086,225 B2 * 10/2018 Sheppard ..... A63B 21/0722
10,172,427 B2 * 1/2019 D'Jay ..... B65D 25/40
10,722,010 B2 * 7/2020 D'Jay ..... A45B 9/02
2003/0145881 A1 * 8/2003 Harroun ..... A61H 3/00 135/65
2003/0203792 A1 * 10/2003 Pestes ..... A63B 21/225 482/60
2008/0302402 A1 * 12/2008 Ryan ..... A61H 3/04 135/67
2009/0159106 A1 * 6/2009 Schulz ..... A45B 9/02 135/75
2010/0051077 A1 * 3/2010 McGann ..... A45B 9/04 135/76
2011/0143893 A1 * 6/2011 Marcantonio .... A63B 23/03541 482/112
2012/0200133 A1 * 8/2012 Simpson ..... A61G 5/10 297/397
2014/0261588 A1 * 9/2014 LaFord ..... A61H 3/0288 135/66
2019/0069650 A1 * 3/2019 Walker ..... A45B 3/00
2020/0029662 A1 * 1/2020 D'Jay ..... A45B 1/00

* cited by examiner

WEIGHTED WALKER ATTACHMENT SYSTEM

CROSS-REFERENCE TO RELATED APPLICATIONS

This application claims the benefit under 35 U.S.C. § 119(e) of U.S. Provisional Application No. 62/729,100, filed Sep. 10, 2018, and U.S. Provisional Application No. 62/848,677, filed May 16, 2019, each of which is hereby incorporated by reference in its entirety.

TECHNICAL FIELD OF THE INVENTION

The present invention relates generally to physical therapy devices, and more particularly relates to walker and assistive devices for perambulatory therapy, and even more particularly, to a weighted walker attachment system using an adjustable weighting kit attachable to such walker and assistive perambulatory devices.

BACKGROUND OF THE INVENTION

Weights on walkers and assistive devices have commonly been used in rehabilitation and physical therapy for diagnoses and diseases that effect motor planning, coordination, balance, body awareness, and stability. A common assistive walker device used in physical therapy is illustrated in FIG. 1, and generally comprises a supportive frame of generally light-weight tubular metal construction adapted to support the weight of a patient as they walk. Commonly seen diagnoses that have shown benefit from added weight on such an assistive device include Parkinson's, stroke, cerebellum disorders, medically-induced ataxia, and spinal cord injury. Proprioception sense has also been proven to decrease with age, movement disorders, neurological deficits and dementia. However, at the same time, the elderly often rely on their sense of proprioception as vision and vestibular functioning declines with age-related changes. Therefore, it is crucial to ensure a person is able to access this sensory system to remain independent.

The purpose of adding weights to the patient's legs (via ankle weights) or placing weights on walkers and assistive devices is to increase proprioceptive feedback to the affected side or sides (this could be right, left, front or center) in order for the brain to have increased awareness and ability to perform functional tasks with improved motor control. In turn, this approach has given the patient the ability to ambulate, transfer, and stand with an increased level of independence. Generally, weights can be adjusted (by either increasing or decreasing the weighted amount) with increased therapy and over the course of time as improvement is shown or needed. Heretofore, weight has been added to walker devices by taking pre-existing ankle weights and loosely adding them to the walker frame, secured, for example, by Velcro straps or tape.

Once a patient has shown benefit from weights on an assistive walker device with improved ability to ambulate and balance, the concern is that such improvement is unlikely to carryover once they return back to the community (e.g., back to their own homes and away from a rehabilitation setting). It is unsafe to suggest a patient use ankle weights without the supervision of a therapist as this poses as a fall risk and increases risk of skin tears. Placing ankle weights on a walker device seems easier; however, the barrier lies with the appearance, and also the patient's own ability, strength and dexterity to place ankle weights on and off of the walker accurately and appropriately. For example, some patients may have difficulty in managing the Velcro straps due to difficulty with fine motor coordination. If the patient is relying on weights on their ankles every time they stand and walk, the risk of falls, skin tears and the load of donning and doffing the weights increases. Additionally, some elderly patients may be hard-of-sight, and may have difficulty accurately placing the weights on a walker, and moreover, may no be able to tell which weight even to use. If the wrong weight is used, or mismatched weights are mounted on different sides of the walker, or the weights are not even properly attached to the walker, then there can be deleterious effects on the therapy and the patient's health.

Accordingly, what is needed is a weighted walker attachment system that is easy to use by therapists and patients alike to adjust the weight of a walker device for therapeutic and rehabilitation purposes. Additionally, there is a need for a weighted walker attachment system that can be easily mounted to and equally easily removed from the walker device. Additionally, there is a need for such a system whereby the weights on the walker can be easily adjusted in accordance with a therapy regime, and further where the different weights that can be used on a walker device can be easily identified so as to eliminate risk of the wrong weights being used. In general, an aim of the present invention is to provide weighted walker attachments that overcome the problems and drawbacks associated with prior art walker devices and weighted-assistance approaches, and therefore significantly improve the utility of walker devices in physical therapy and rehabilitation.

SUMMARY OF THE INVENTION

In accordance with embodiments of the present invention, a weighted walker attachment system generally comprises one or more weighted walker attachments that can be mounted to standard walker, rollator and other assistive perambulatory devices for use in physical therapy and rehabilitation. Such a standard walker device is illustrated in FIG. 1, and generally comprises a supportive frame of generally light-weight longitudinally-extending tubular metal construction. In accordance with a first aspect of the present invention, a plurality of weighted attachments are provided and adapted to be mounted at a variety of locations on the standard walker or rolling walker device, such as on the legs, side supports, handles, and cross members thereof.

In accordance with preferred embodiments of the present invention, a plurality of weighted attachments can be used and positioned in accordance with a specific physical therapy plan, and the weight of each such attachment can be modified as necessary. For example, the walker device can be provided with weighted attachments on any combination of the front and rear legs, side supports, handles and cross members, or in the alternative only use a single attachment anywhere on the walker device. In accordance with some physical therapy plans, only a single attachment set-up may be needed. In other plans, different weighted amounts can be provided on different locations of the walker devices—such as, attachments being provided on both front legs, but with one leg having greater weight than the other leg. As a result, the present invention provides flexibility so that a specific plan for rehabilitation can be crafted for a specific patient's needs.

In accordance with preferred embodiments of the present invention, a kit is provided that includes sets of weighted plates that can be easily connected together to increase weight for each attachment, as needed. With such a design, plates can be added or removed to adjust the weight applied to the walker device in accordance with a patient's development and improvement. In this regard, the weighted walker attachment system of the present invention may be used progressively with a patient's therapy regime.

Each weighted walker attachment is built to easily and safely fit the standard walker device, so that existing devices can be retrofitted with a weighted attachment in accordance with the present invention. In general, such attachments include means for easily mounting the attachment to the walker device, such as by clamps, clips, magnets, ties, Velcro, adhesive, snap fit connections, or the like. Such attachment means are adaptable to the shape and form of the walker device, and are easy for patients to assemble and disassemble themselves, as well as allowing such patients to easily add or remove weight, as needed. Indeed, the attachments can be used with a variety of walker and rollator designs, as well as canes, crutches and other assistive devices.

In another aspect of the present invention, a weighted walker attachment kit may be provided that includes sets of interchangeable attachments at varying weights, so that the kit and system of the present invention can be used progressively with a patient's therapy regime. That is, weighted attachments can range, for example, from 1-5 pounds, each weight being coded to indicate its weight in distinction with other weights so as to facilitate use of the proper weight(s). For example, each attachment can be coded by color. Additional visual and tactile distinguishing marks—e.g., numbers, words, shapes, raised features, Braille, and the like—may also be used so that hard-of-sight patients can determine which weights to use for therapeutic purposes.

In an alternate embodiment of the present invention, a kit is provided with four attachments at each of five different weight levels that can be retrofitted to a walker device—for example, by attachment to the walker's legs. Such attachments simply slide over the end of the walker structure (often replacing existing parts of the walker device) and can be adjusted in accordance with standard use of the walker device. Each different weight level may be color coded to assist use of the proper weight. As noted, each weighted walker attachment is built to fit the standard walker so that such devices can be retrofitted with a weighted attachment. Unlike, prior art methods, where loose ankle or wrist weights and wrapped around parts of the walker, such attachments essentially form part of the walker device structure itself and therefore do not inhibit or interfere with intended use of the walker once properly mounted.

Further variations to a weighted attachment system in accordance with the present invention may include weighed ball attachments to place on portions of the walker device (such as the end of the legs); hinged weighted clamps to snap-fit on the walker frame; fully color coded replacement legs; a weighted bar across the front of the walker or horizontally between legs; weighted sleeves to slide up and over the walker legs; or an entire weighted walker device.

Weighted walker attachments in accordance with the present invention address the drawbacks and solve the problems associated with prior art approaches, which generally involve using loose weights wrapped around portions of the walker and affixed thereto by Velcro. Moreover, the system of the present invention allows for consistent and appropriate distribution of weight in order to ensure neural feedback and proprioception to increase independence of the patient. The weighted attachments of the present invention can be graded for progression through rehab or fit for long-term use to compensate for movement disorders that are progressive in nature (i.e., Parkinson's).

The present invention allows for further adaptation to a commonly used assistive device (walker). The attachments described and shown herein are easy to mount and retrofit to existing walker devices. Indeed, they are generally attached to and/or even replace preexisting parts, and are designed to be mounted in the same way as the parts they are replacing, without altering the functional design and operation of the walker devices. In this regard, the weighted walker attachments are also easy to remove and replace, and adjust the applied weight—for example, to downgrade or upgrade the weight levels, as desired or deemed necessary. This allows for more patients to continue to use an assistive walker device who would otherwise not be ambulatory. The weighted walker attachment system in accordance with the present invention also increases the consistency and ease of implementing proprioceptive and neural feedback interventions in both the therapy setting and at home. The variety of weights (e.g., 1-5 lbs.) and the ability to grade and individualize the intervention thereof is crucial in each patient's success.

Moreover, the weighted walker attachment system and kit of the present invention allows for flexibility in application so that if a patient needs more weight on one side of the walker than the other, then this can be done without affecting the use and structure of the walker device itself.

These and other objects, features and advantages of the present invention will become apparent in light of the detailed description of embodiments thereof, as illustrated in the accompanying drawings.

DETAILED DESCRIPTION OF PREFERRED EMBODIMENTS

Figure 1:
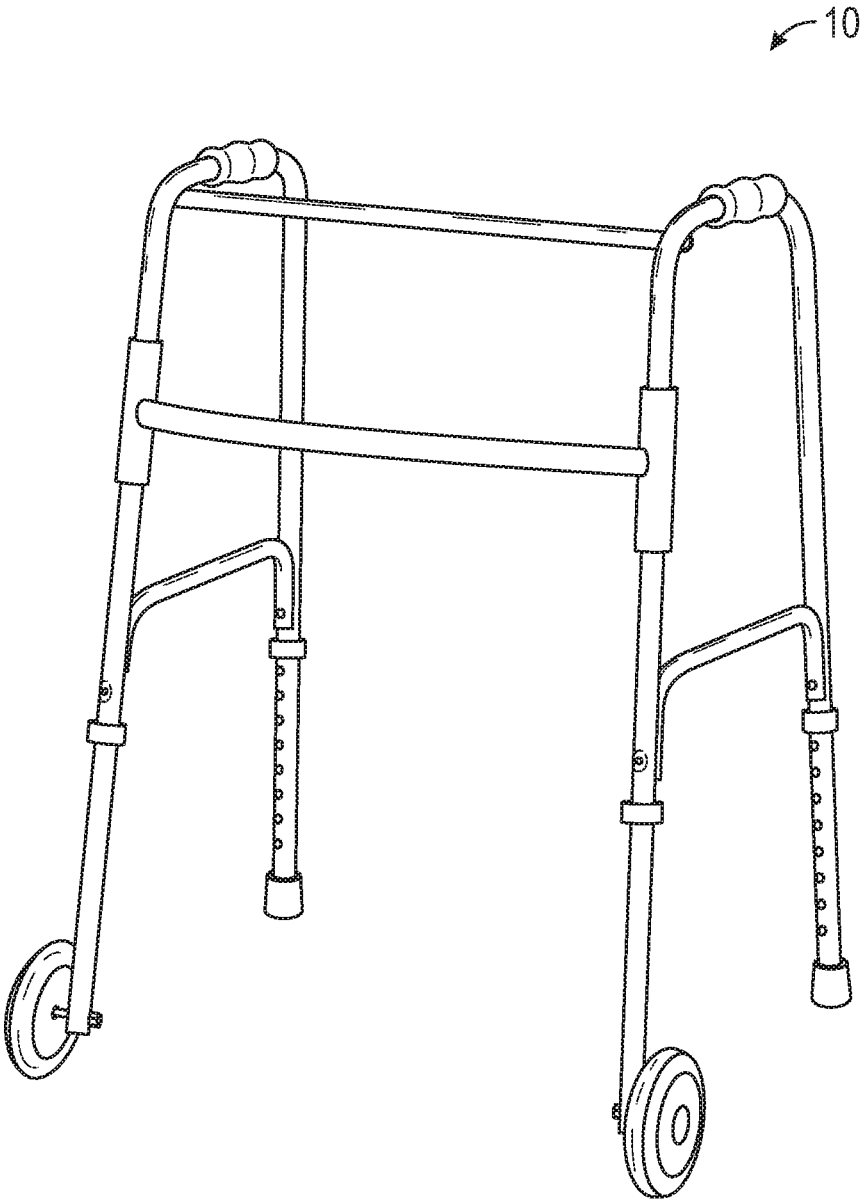
FIG. 1 (Prior Art)
FIG. 1 illustrates a prior art walker device with which the weighted walker attachment system of the present invention can be used.
Figure 2:
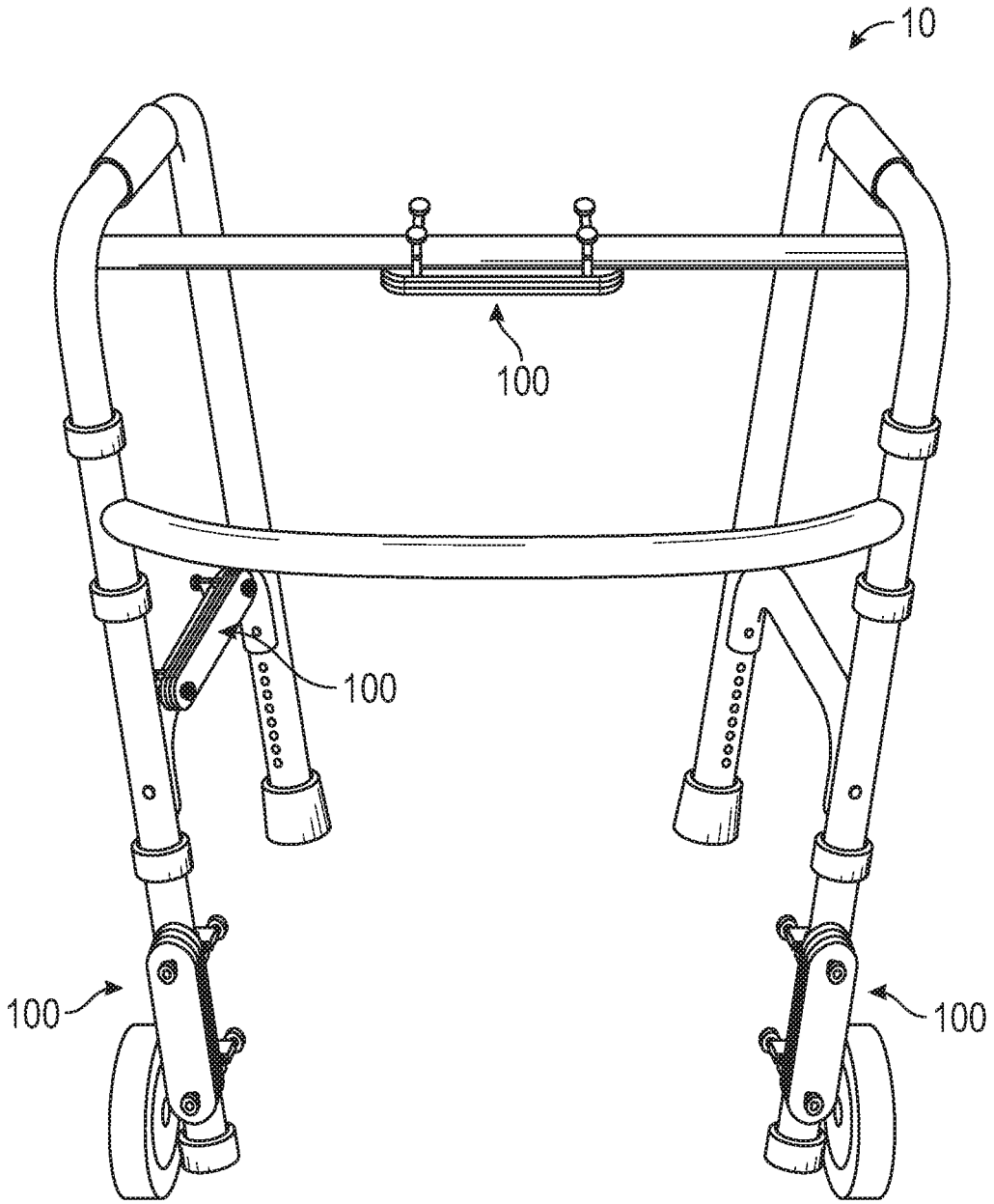
FIG. 2 illustrates the prior art walker device of FIG. 1 with a plurality of weighted walker attachments in accordance with an embodiment of the present invention attached thereto.
Figure 3A:
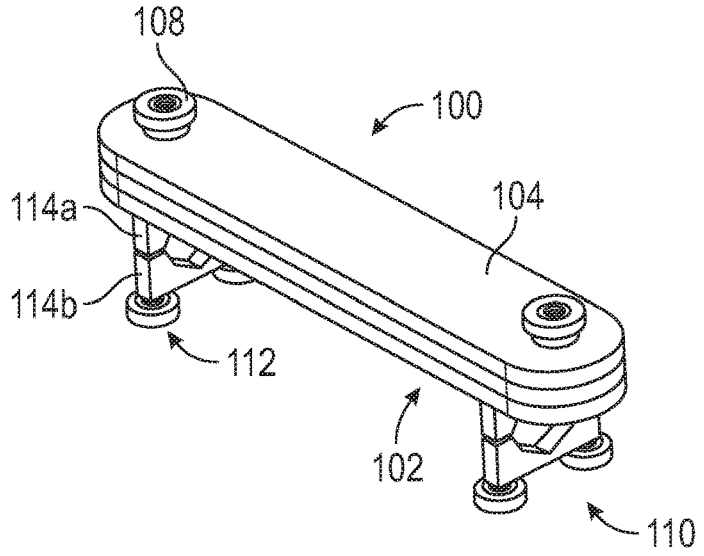
FIGS. 3A and 3B illustrate the front and rear of a weighted walker attachment in accordance with a first embodiment of the present invention for use with the walker device of FIG. 1.
Figure 3B:
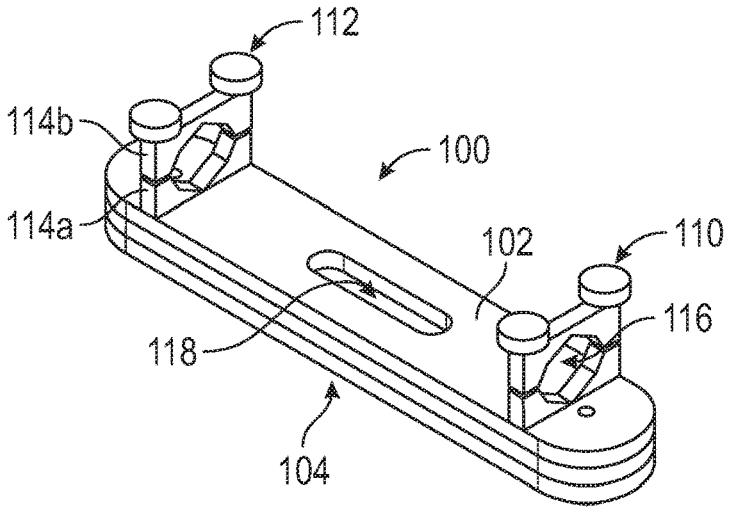
Figure 6:
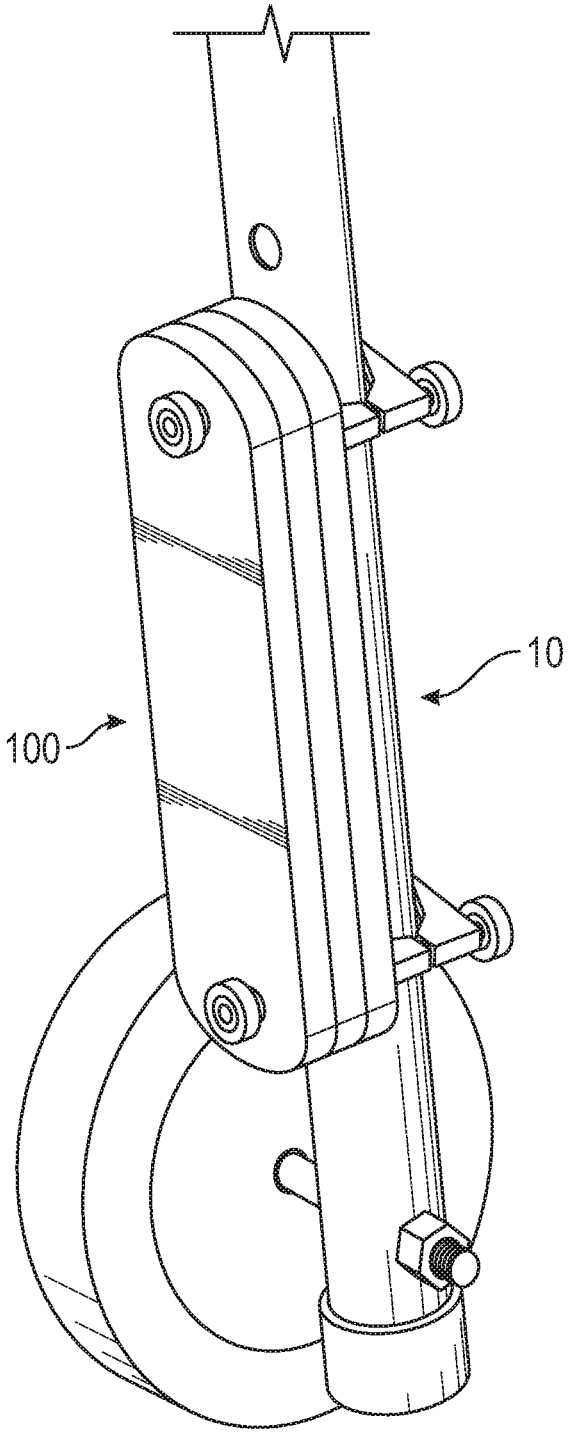
FIG. 6 illustrates a close-up view of the weighted walker attachment system of FIGS. 3A and 3B attached to the leg of the walker device of FIG. 1.
Figure 7:
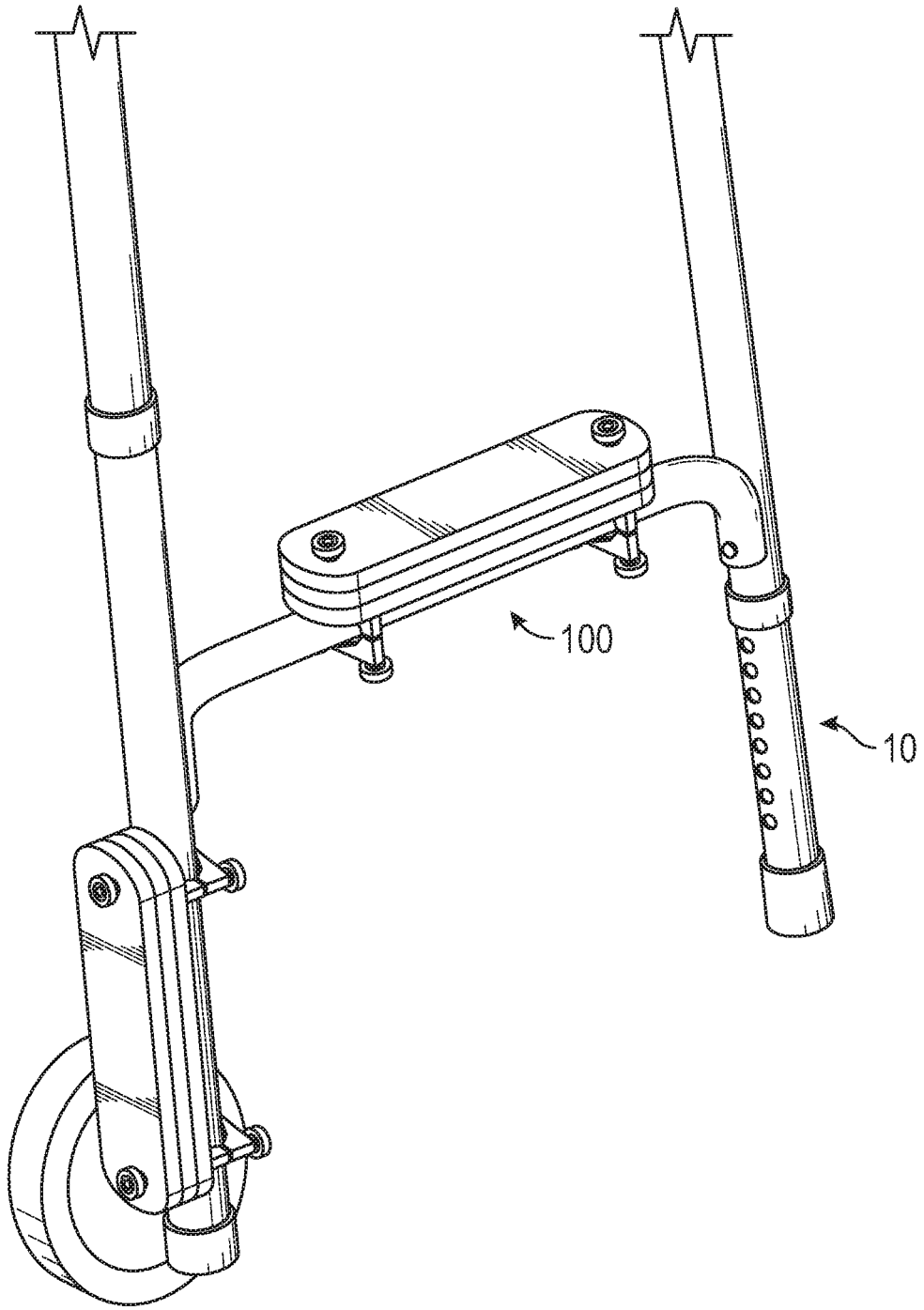
FIG. 7 illustrates a close-up view of the weighted walker attachment system of FIGS. 3A and 3B attached to a horizontal side member of the walker device of FIG. 1.
Figure 8:
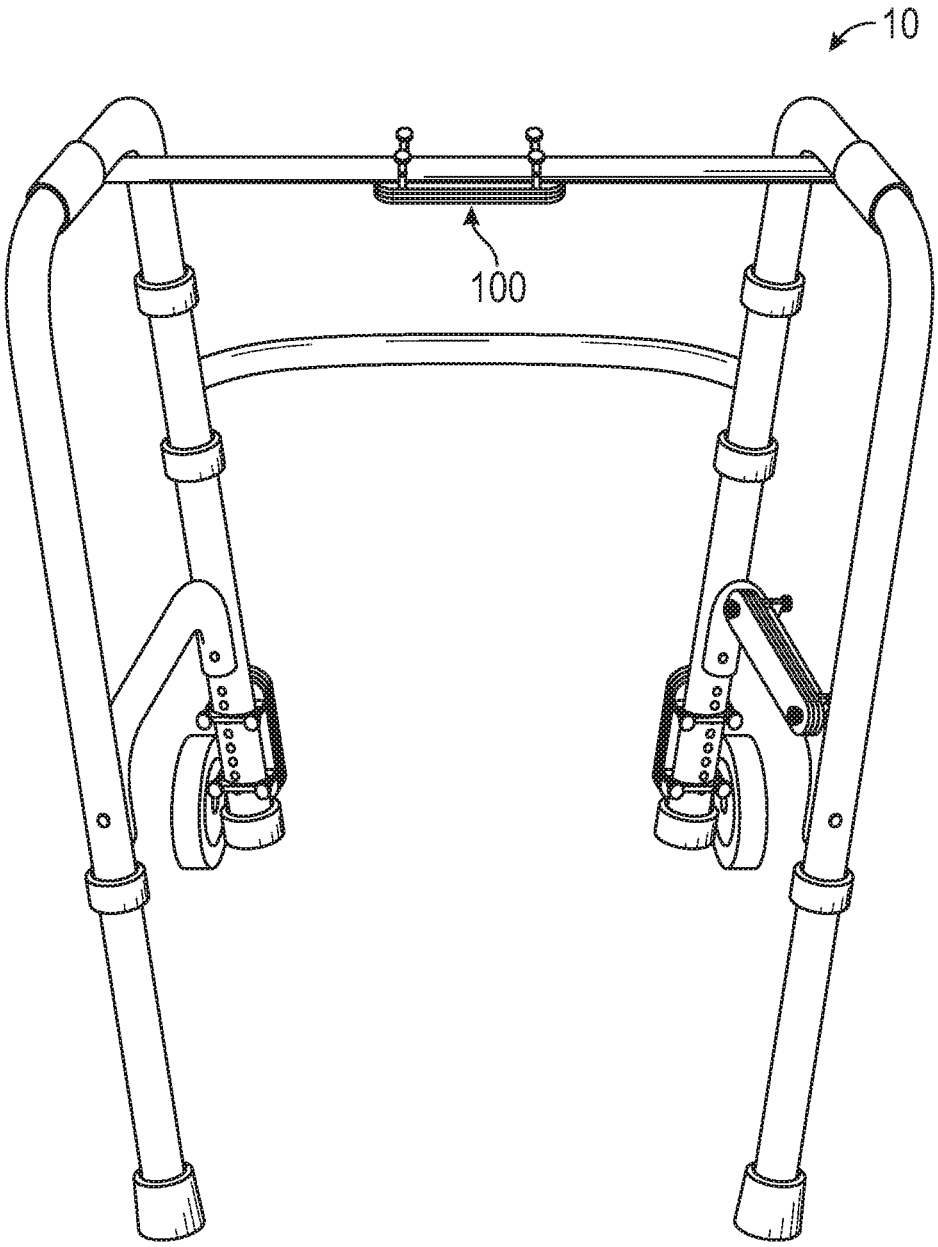
FIG. 8 illustrates a close-up view of the weighted walker attachment system of FIGS. 3A and 3B attached to a horizontal cross-member of the walker device of FIG. 1.

A weighted walker attachment system in accordance with preferred embodiments of the present invention is illustrated in FIGS. 3A-3B for use in connection with a standard walker, rollator, cane, crutches and other assistive perambulatory devices. In FIG. 2, weighted walker attachments, generally designated by reference numeral 100, are attached in multiple locations on the standard walker device 10 of FIG. 1, including, for illustration purposes, on each of the front legs, a side support, and a cross member, shown more closely in FIGS. 6-8. Essentially, a weighted walker attachment 100 in accordance with a preferred embodiment of the present invention can be mounted to any longitudinal frame member of the walker device 10 or any similar assistive device. Walker devices typically comprise a supportive frame of generally light-weight longitudinally-extending tubular construction, so there are many places on which a weighted walker attachment 100 in accordance with the present invention can be mounted to add weight to the walker device 10. In further accordance with the present invention, a plurality of such weighted attachments 100 can be used in accordance with a specific physical therapy plan, and the weight and position of each such attachment 100 can be selected and modified as necessary in accordance with the present invention.

Figure 4A:
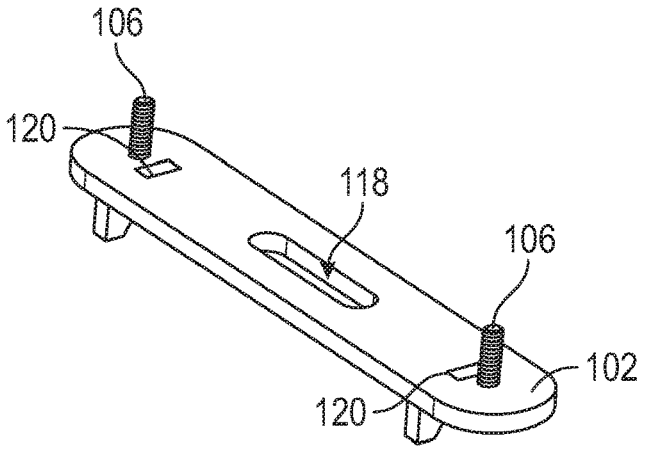
FIGS. 4A and 4B illustrate the front and rear of the weighted walker attachment of FIGS. 3A and 3B with the weighted plates removed for illustration purposes.

Referring to FIGS. 3A-3B, a preferred design of the weighted attachment 100 comprises a base plate 102 and a plurality of weighted plates 104 that can be stacked and connected to together by setscrew mechanisms 106 located on each end of the attachment 100. As illustrated in FIG. 4A, setscrew mechanisms 106 project from the base plate 102 and additional weighted plates 104 can be mounted to the base plate 102, as desired, and secured in place with thumb nuts 108. Preferably, each of the plates 102, 104 has the same general size, shape and weight, as illustrated, so as to facilitate the use and adjustment of the attachment 100. In use, therefore, the weight of the attachment 100 can be increased or decreased by varying the number of weighted plates 104 mounted to the base plate 102. However, alternate kit designs can use a system of interchangeable plates having different individual weights, and used, for example, in accordance with a progressive therapeutic regime and rehabilitation plan without departing from the spirit and principles of the present invention. In use, therefore, plates with predefined weights can be swapped out as needed.

Figure 4B:
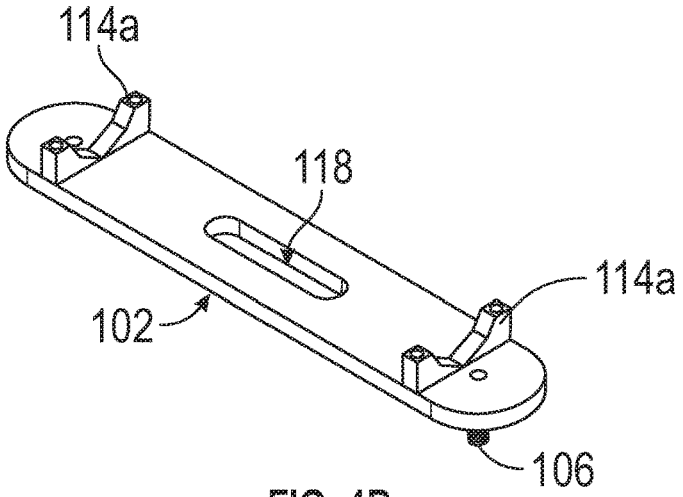

Referring to FIGS. 3B and 4B, the base plate 102 also includes attachment means for mounting and securing the weighted attachment 100 to the walker device 10. As illustrated in FIGS. 3B and 4B, attachment clamps 110 are provided on the rear side of the attachment base plate 102 for securing the attachment 100 to a tubular member of the walker 10. For example, such clamps 110 are provided on each longitudinal end of the base plate 102 and secured into place by setscrews or lock screws, generally designated as reference numeral 112, or the like. Such attachment means are adaptable to the shape and form of the walker device 10, and are easy for patients to assemble and disassemble themselves, as well as allowing such patients to easily add and remove weight, as needed. Moreover, once the base plate 102 is mounted, the weight of the attachment 100 can be adjusted without needing to remove the base plate 102 from the walker device 10.

In the embodiment illustrated, the clamps 110 comprise first and second clamp portions 114*a* and 114*b* that are fitted together to collectively define a central opening 116 in which the frame member of the walker device 10 is situated. As illustrated, the clamps 110 are adaptable to rounded, oval, or even rectilinear frame members, and by tightening each of the screws 112, the first and second clamp portions 114*a* and 114*b* are securely held together and the attachment 100 can be tightly held in place during use. As so designed, the attachment 100 can also be used on other assistive devices, such a various walker and rollator designs, canes and crutches. Alternate designs of the clamps, including a one-piece C-clamp design, can be used without departing from the spirit and principles of the present invention. Moreover, alternative attachment means can be used to mount the attachment 100 to the walker device 10 without departing from the spirit and principles of the present invention, including but not limited to clips, magnets, ties, Velcro, adhesive, snap fit connections, or the like.

Figure 5A:
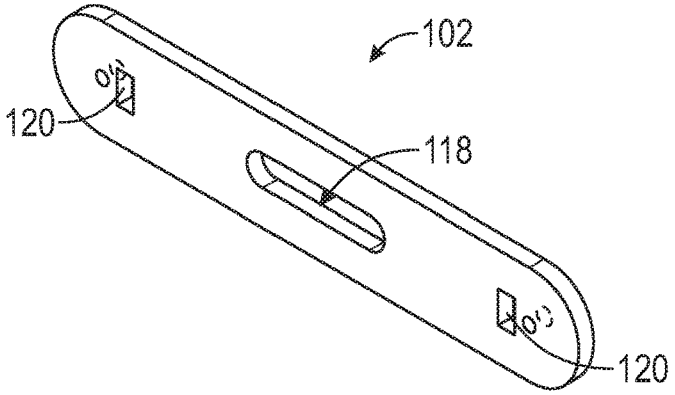
FIG. 5A illustrates an exemplary base plate and FIG. 5B illustrates and exemplary weighted plate for the weighted walker attachment system of FIGS. 3A and 3B in accordance with preferred embodiments of the present invention.
Figure 5B:
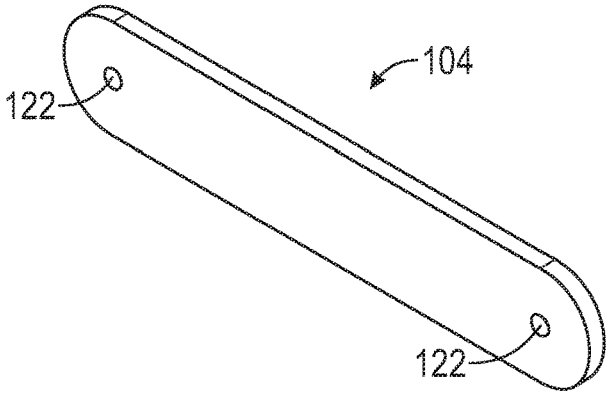

An exemplary base plate 102 is illustrated in FIG. 5A and an exemplary weighted plate 104 is illustrated in FIG. 5B. The base plate 102 may be provided with a central longitudinal slot 118, as illustrated in FIG. 5A. This slot 118 can be used to help properly align the base plate 102, and thus the entire attachment 100, relative to the frame member to which it is secured. That is, the user can optically see the frame member through the slot 118 and ensure that the base plate 102 is straight and centrally located before securing it in place with the attachment means 110. The base plate 102 also has clamp openings 120, shown in FIG. 5A, for mounting the clamps 110 to the base plate 102, as shown in FIG. 4*b*. Preferably, the first clamp portion 114*a* snap fits into the clamp opening 120. In this design, different base plates—for example, having different weights—can be interchanged, as desired and in accordance with a particular therapy plan. In alternate designs, the clamps 110 can be permanently affixed to the base plate 102 to prevent separation during use.

As noted, the weighted plates 104 can all have the same size, shape and weight, such as illustrated in FIG. 3A, and the weight of the attachment 100 can be adjusted by adding or removing the weighted plates 104, as desired. In alternate embodiments, the weighted plates 104 can have varying weights so that the attachment 100 can be adjusted by selecting a particular plate from a kit corresponding to a desired weight. As illustrated in FIG. 5B, each weighted plate 104 is provided with openings 122 on each end permitting the weighted plate 104 to be slid onto the setscrew mechanisms 106 and mounted to the base plate 102. Once positioned, the weighted plates 104 are secured into place with the thumb nuts 108.

In alternate embodiments of a weighted walker attachment system and kit in accordance with the present invention, other shapes and designs can be used to add weight to the walker device 10, such as weighted leg extensions, described in more detail below, or separate balls and bars that can be mounted to the walker device.

In accordance with preferred embodiments of the present invention, a plurality of weighted attachments 100 can be used and positioned in accordance with a specific physical therapy plan, and the weight of each such attachment 100 can be modified as necessary. For example, the walker device 10 can be provided with an attachment 100 on each of the front legs, a side support, and a cross member, as illustrated in FIG. 2. Such attachments 100 can also be added to the rear legs and the handles of the walker 10. Additional physical therapy plans may only need a single attachment set-up—for example, with one weighted attachment 100 mounted to one of the front legs. In other plans, weighted attachments 100 could be needed on both front legs of the walker 10, but with one leg requiring greater weight than the other leg because a patient's rehabilitation plan requires focusing more particularly on one side of the body. Thus, for example, two 2 lb. weight attachments 100 can be used on the right side of the walker (e.g., a base plate 102 with two weighted plates 104), whereas, lighter attachments 100 can be used on the left side, such as a pair of weighted attachments 100 at a different weight level (e.g., a base plate 102 with one weighted plate 104). Accordingly, the present invention provides flexibility so that a specific plan for rehabilitation can be crafted for a specific patient's needs.

In accordance with preferred embodiments of the present invention as discussed above, a weighted attachment kit is provided that includes sets of base plates 102 and weighted plates 104 that can be easily connected together to increase weight for each attachment 100, as needed. With such a design, plates 104 can be added and removed to adjust the weight applied to the walker device 10 in accordance with a patient's development and improvement. In this regard, the weighted walker attachment system 100 of the present invention may be used progressively with a patient's therapy regime.

Each weighted walker attachment 100 is built to easily and safely fit the standard walker device 10 made by major companies such as Invacare and Drive, so that existing assistive perambulatory devices can be easily retrofitted with weighted attachments 100 in accordance with the present invention without inhibiting intended use of the walker device. In general, such attachments 100 include means for easily mounting the attachment to the walker device, such as by clamps, clips, magnets, ties, Velcro, adhesive, snap fit connections, or the like.

Figure 9:
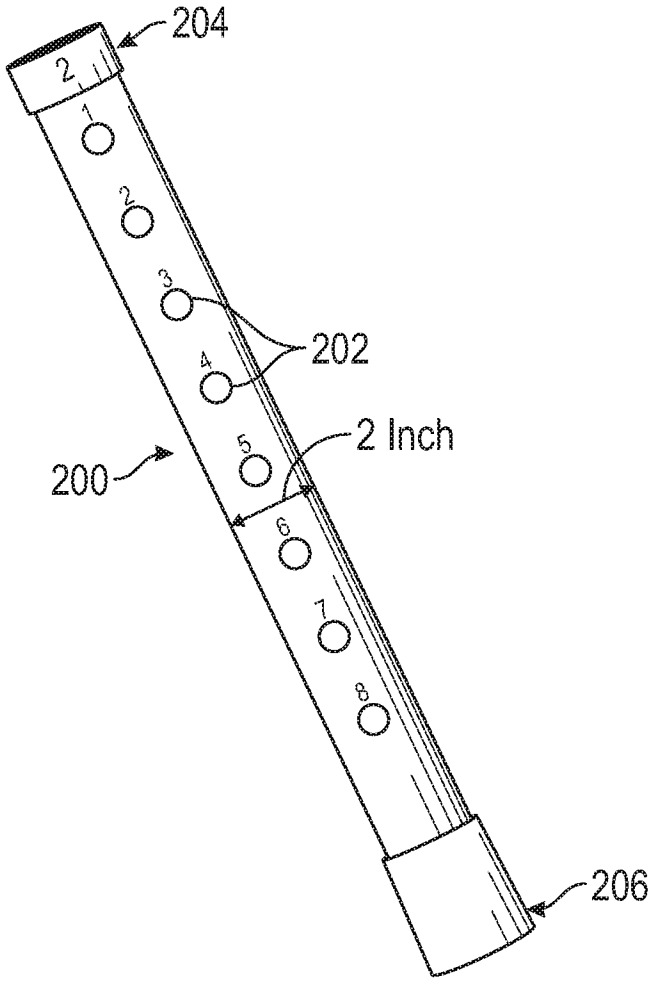
FIG. 9 illustrates a weighted walker attachment kit in accordance with a second embodiment of the present invention for use with a leg of the walker device of FIG. 1, with interchangeable attachments weighted at different weight levels.
Figure 9:
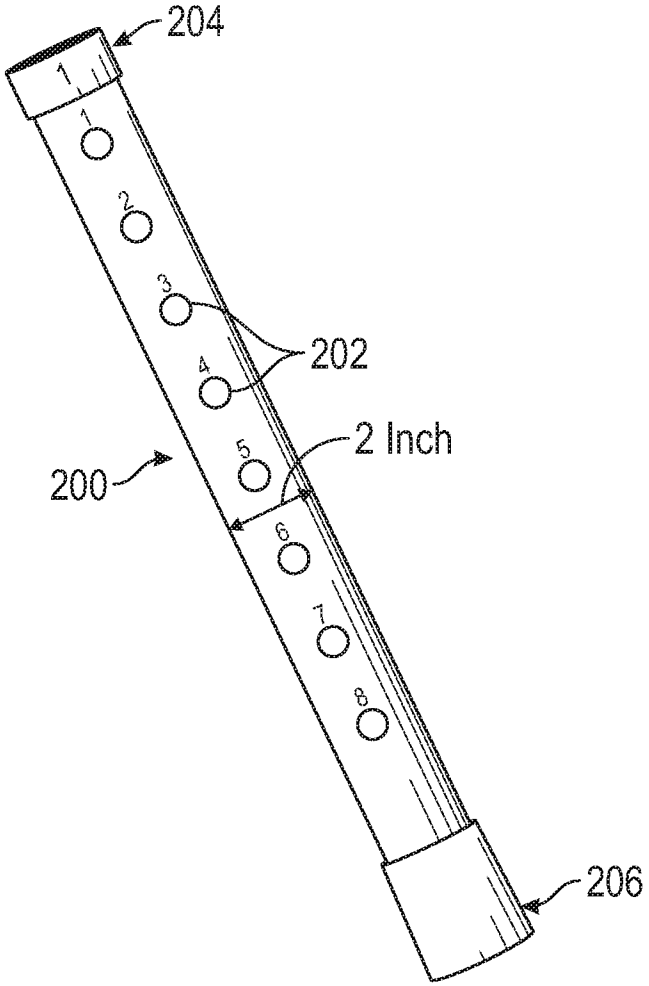
Figure 10:
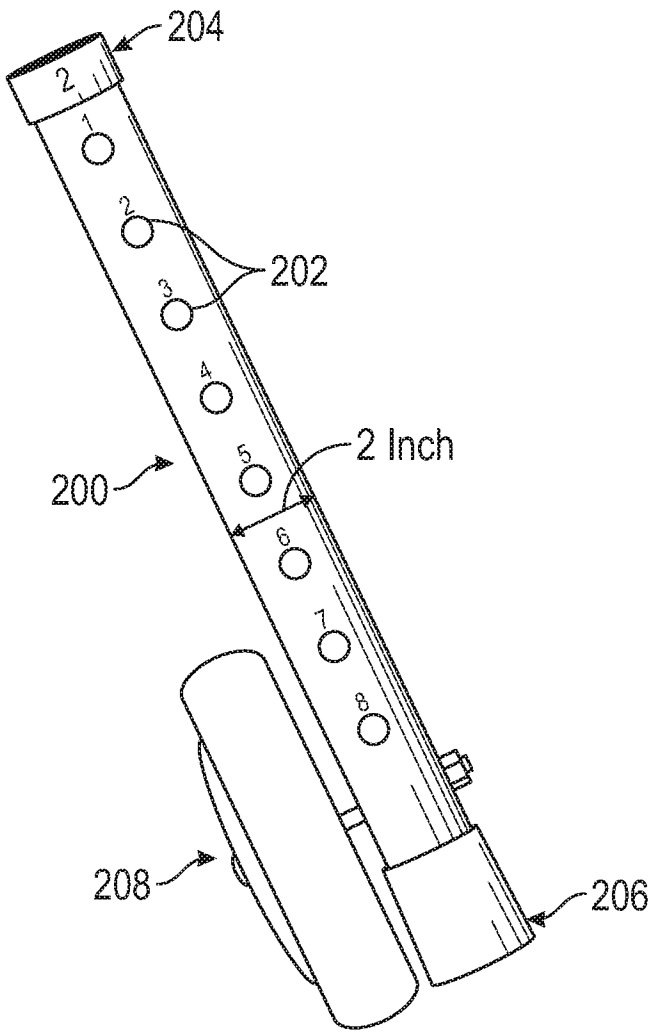
FIG. 10 illustrates an alternate design of the weighted attachments of FIG. 9 comprising interchangeable wheeled attachments for use with a leg of the walker device of FIG. 1 and weighted at different weight levels.
Figure 10:
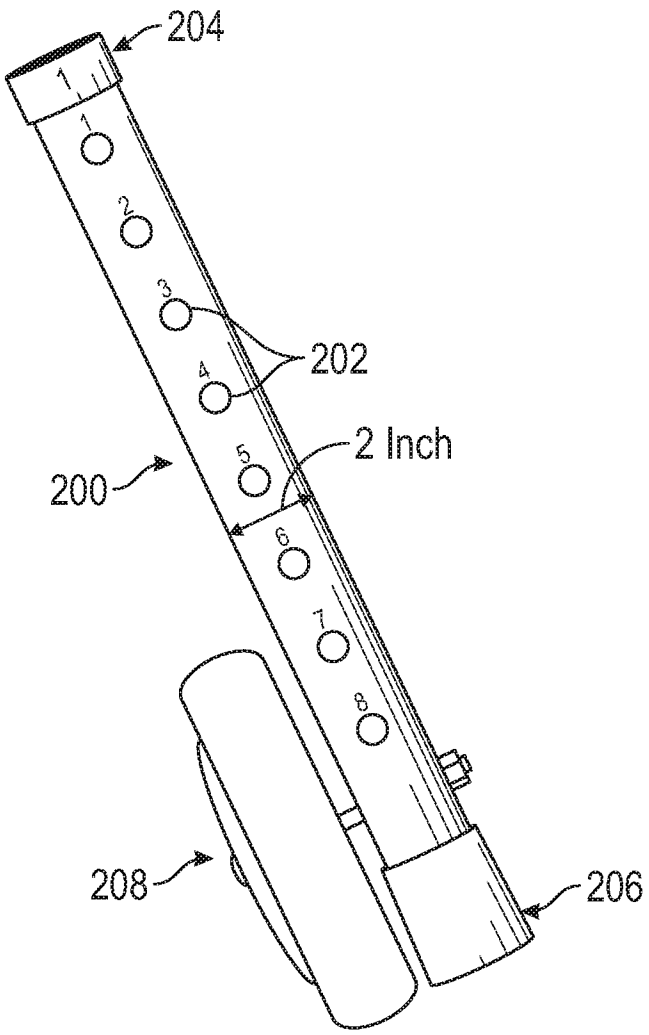

An alternate design for a weighted walker attachment system, generally designated as reference numeral 200, is illustrated in FIGS. 9-10. In such an alternate embodiment of the present invention, a weighted attachment kit is provided with four attachments 200 at each of five different weight levels that can be retrofitted to a walker device 10—for example, by attachment to the walker's legs. Each different weight level is color coded to assist use of the proper weight. For example, the different sets of attachments within the kit can be coded as follows:

Red-1 lb
Orange-2 lb
Green-3 lb
Blue-4 lb
Black-5 lb

As noted, each weighted walker attachment 200 is built to fit the standard walker device 10 so that such devices 10 can be easily retrofitted with a weighted attachment 200. Unlike, prior art methods, where loose ankle or wrist weights and wrapped around parts of the walker device 10, such attachments 200 essentially form part of the walker device structure itself and therefore do not inhibit or interfere with intended use of the walker device 10 once properly mounted. In accordance with aspects of the present invention, the customer or therapist has the option to purchase an entire kit of attachments 200—generally comprising four or five attachments 200 at multiple varying weight levels—or individually, based on the needs of the individual patient.

Referring to FIGS. 9 and 10, a first design of the weighted attachment 200 comprises a tubular extension adapted to fit over the rear and front legs of the standard walker device 10. Such common walker devices 10 typically are provided with adjustable leg extensions on each of the four legs to modify the height of the walker device 10. As illustrated in FIG. 1, the rear legs are provided with pads/caps 206 that contact the ground, while the front legs can be provided with wheels 208 to aid a patient's perambulatory movement. In accordance with the present invention, the weighted attachments 200 are designed to replace the existing leg extensions with weighted extensions. Thus, the weighted attachments 200 are provided in standard form—i.e., with a pad/cap 206 at the bottom, or with wheels 208, as illustrated in FIGS. 9 and 10, respectively. The attachments 200 simply side over the end of the walker structure and can be adjusted in accordance with standard use of the walker device 10. Further, the attachments 200 are generally held in place via a spring-biased projection on the walker 10 that projects through one of the adjustment holes 202 provided on each attachment 200, as illustrated.

In the illustrated embodiment of the attachments 200, the weight is generally provided in the cylindrical tubular extension of the attachment 200 itself. Alternative or additional weighting approaches can be used without departing from the spirit and principles of the present invention. For example, the top and/or bottom sleeves or caps 204 and 206 on the attachment 200 can be used to provide, or increase, the weight of the attachment 200. Other designs could include attaching additional components to increase the weight, such as magnetic sleeves or plates. In yet another embodiment, means could be provided to allow for the patient or a therapist to adjust the weight without removing the attachment 200 from the walker device 10—for example, a tubular extension that can be filled with water, sand, or the like.

As noted, a kit of weighted attachments 200 can be supplied with extensions having different weights that are distinguishable by visual and/or tactile markers. For example, individual attachments 200 can be distinguished by a color code, indicated, for example, on the top sleeve 204 of each attachment 200. Alternative means can be used for color-coding without departing from the spirit and principles of the present invention. For example, the entire attachment 200 can be colored, or a stripe or unique aesthetic pattern can be provided on the side or other portion of the attachment 200, or the bottom sleeve or cap portion 206, or any combination of these means. As additionally noted above, other distinguishing marks can be used in combination with the color-coding (or even instead if such color-coding). For example, as shown, a number or shape system can likewise be used to indicate different weight levels. Moreover, the numbers or shapes can be tactile and raised, so that a person who is hard-of-sight can feel the number, shape or some other distinguishing tactile feature to assist in identifying the proper attachment 200 to use. Additional visual and tactile distinguishing marks could include numbers, letters, words, shapes, raised features, Braille, and the like.

Further variations to a weighted walker attachment design, instead of the attachments 100 and 200 illustrated may include weighted ball attachments to place on the end of the walker legs; hinged weighted clamps to snap onto the legs of walker device; an entirely weighted walker device; a weighted bar across the front of walker or horizontally between legs; and/or weighted sleeves to slide up and over walker legs.

Based on research and knowledge of the existing prior art, nothing exists of the nature for the weighted attachment system present herein. The only option for therapists and patients at this point has been to add pre-existing weights designed for different uses and purposes to walkers, ankles, wrists, or wear weighted vests. There is also the U-walker, which is created specifically for Parkinson's disease and is in rollator form. Rollators are less stable than traditional walkers and do not have the ability to adapt to different leg settings. The traditional U-walker is not weighted, therefore, not designed to increase proprioceptive feedback. Accordingly, the present invention allows for easy adaption to commonly used assistive device with an adjustable weighted attachment system that is easy to mount and retrofit to existing walker devices. Indeed, the weighted walker attachment system of the present invention generally attaches to or even replaces preexisting parts of existing walker devices without altering the functional design of such devices. Moreover, the weighted walker attachment system is easy to remove and replace, and a patient can likewise easily adjust the amount of weight added. As a result, patients may use a weighted walker device where they would otherwise not be ambulatory, which increases the consistency and ease of implementing proprioceptive and neural feedback interventions in both the therapy setting and at home.

Additional goals for the present invention include increasing a patient's independence with walking, transfers and general activities of daily living's within the patient's environment; decrease the risk of falling; improving the patient's quality of life when using an assistive perambulatory device, as well as decreasing the risk of isolation related to immobility and underlying disease; improving the patient's coordination and motor planning when walking and transferring; increasing the patient's midline awareness and postural control when standing; and decreasing ataxia during gait when applicable.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A weighted walker attachment system adapted for use with a physical therapeutic walker device, said walker device comprising a frame having at least one elongated frame member, said weighted walker attachment system being adapted to be removably attached to the at least one elongated frame member of the walker device and comprising:

a base with first attachment means for attaching said base to the at least one elongated frame member, said base having a first weight value; and one or more weighted members removably attachable to the base with second attachment means, whereby each of said one or more weighted members has a weight value that is the same or different from the first weight value;

wherein each of the one or more weighted members is configured to be attached to and detached from the base, wherein the base remains engaged with the at least one elongated frame member.

2. The weighted walker attachment system according to claim 1, wherein the first attachment means comprise at least one clamp adapted to engage the at least one elongated frame member.

3. The weighted walker attachment system according to claim 1, wherein the base comprises a longitudinally extending base plate.

4. The weighted walker attachment system according to claim 3, wherein the first attachment means comprise first and second clamps positioned at respective longitudinal ends of the base plate and adapted to engage the at least one elongated frame member and be secured by respective setscrews.

5. The weighted walker attachment system according to claim 3, wherein the base plate includes a longitudinal slot for aiding in positioning the base plate on the at least one elongated frame member.

6. The weighted walker attachment system according to claim 1, wherein said second attachment means comprise at least one projection extending from the base and on which the one or more weighted members can be mounted, and a corresponding nut adapted to engage the at least one projection to secure the one or more weighted members in place relative to the base.

7. The weighted walker attachment system according to claim 1, wherein the weighted walker attachment system comprises a plurality of weighted members that can be selectively attached to the base in various combinations to alter the weight of the weighted walker attachment system.

8. The weighted walker attachment system according to claim 7, further comprising indicia provide on each of the plurality of weighted members to identify the weight of each individual weighted member relative to the other weighted members of the plurality.

9. The weighted walker attachment system according to claim 7, wherein the one or more weighted members are removably attachable to the base in stacked relationship to the base and with respect to other weighted members.

10. The weighted walker attachment system according to claim 1, wherein operation of the second attachment means is independent from operation of the first attachment means.

11. The weighted walker attachment system according to claim 1, wherein the one or more weighted members are removably attachable to the base in stacked relationship to the base and with respect to other weighted members.

* * * * *